US005988630A

United States Patent [19]

Kawaura

[11] Patent Number: 5,988,630

[45] Date of Patent: Nov. 23, 1999

[54] SHEET FEEDER HAVING COLLAR STRUCTURE FOR IMPROVED FEEDING AND PRINTER THEREFOR

[75] Inventor: Masafumi Kawaura, Nagoya, Japan

[73] Assignee: Brother Kogyo Kabushiki Kaisha, Nagoya, Japan

[21] Appl. No.: 08/922,588

[22] Filed: Sep. 3, 1997

[30] Foreign Application Priority Data

Sep. 3, 1996 [JP] Japan ..... 8-253720

[51] Int. Cl.[6] ..... B65H 1/00; B65H 29/70; B65H 1/26; B65H 1/08

[52] U.S. Cl. ..... 271/161; 271/188; 271/157; 271/145; 271/126

[58] Field of Search ..... 271/161, 188, 271/209, 157, 145, 126, 127

[56] References Cited

U.S. PATENT DOCUMENTS

| | | | |
|---|---|---|---|
| 4,813,612 | 3/1989 | Kano et al. | 271/127 |
| 4,900,005 | 2/1990 | Blythe et al. | 271/157 |
| 5,152,522 | 10/1992 | Yamashita | 271/161 |
| 5,312,108 | 5/1994 | Hayashi | 271/188 |
| 5,437,444 | 8/1995 | Kawakami et al. | 271/127 |
| 5,449,161 | 9/1995 | Gysling | 271/117 |
| 5,454,555 | 10/1995 | Kiyohara et al. | 271/145 |

FOREIGN PATENT DOCUMENTS

| | | | |
|---|---|---|---|
| 0109357 | 3/1983 | Japan | 271/188 |
| 0183533 | 10/1983 | Japan | 271/126 |
| 0055031 | 3/1986 | Japan | 271/157 |
| 0286528 | 11/1990 | Japan | 271/126 |
| 403143865 | 6/1991 | Japan | 271/188 |

*Primary Examiner*—William E. Terrell
*Assistant Examiner*—Wonki K. Park
*Attorney, Agent, or Firm*—Oliff & Berridge, PLC

[57] ABSTRACT

The sheet feeder of a recorder includes a sheet support, a shaft extending over the support, a feed roller rotatable on the axis of the shaft, and collars mounted rotatably around the shaft. Disks may be formed on the shaft. Each of the collars is supported rotatably on one of the disks. The inner periphery of at least one of the collars in the widthwise middle area of the support is spaced from the periphery of the associated disk. Even if the support is curved in such a manner that it is convex toward the roller, the distance between the shaft axis and the point or line where the at least one of the collars is in compressive contact with the top one of the sheets stacked on the support is shorter than the distances between the axis and the points or lines where the collars near the lateral ends of the support are in compressive contact with the top sheet. All of the collars can keep the roller and the sheet spaced at a predetermined distance from each other. Consequently, the sheets can be fed properly.

22 Claims, 9 Drawing Sheets

SHEET FEEDER HAVING COLLAR STRUCTURE FOR IMPROVED FEEDING AND PRINTER THEREFOR

FIELD OF THE INVENTION

The present invention relates to a sheet feeder for feeding one after one the sheets of paper stacked on a sheet support, and to a printer fitted with such a feeder. In particular, the invention relates to a sheet feeder which can, even if its sheet support is curved, feed a sheet of paper securely by keeping the sheet spaced at proper distances from the feed rollers of the feeder.

BACKGROUND OF THE INVENTION

An ink jet printer or another conventional printer is fitted with a sheet feeder for feeding one by one the sheets of paper stacked on a sheet support. The feeder includes a rotatable shaft extending horizontally over the support. Fixed to the shaft are semi-cylindrical feed rollers for feeding the sheets one after one. The support is urged toward the rollers by an urging means. A rear portion of the support is covered normally with a cover. The shaft includes disks formed on it. A collar is fitted rotatably on the periphery of each disk. The collars on the disks are smaller slightly in diameter than the rollers. When the cylindrical surfaces of the rollers are away from the support, the collars are in contact with the top sheet so as to keep the sheet spaced at a predetermined distance from the axes of the rollers.

Some sheet feeders of this type each include a sheet cassette fitted with a cover and a sheet support which interlock or work with each other. When the cover opens, it pushes the right and left ends of the support, thereby moving the support against the force of the urging means away from the horizontal rotatable shaft. Consequently, when the cylindrical surfaces of the rollers are away from the support, the support is spaced from the collars so that sheets of paper can be stacked on the support. When the cover closes, the urging means returns the support toward the rollers. This brings the collars into contact with the top one of the sheets stacked on the support. Consequently, the sheet is spaced at a predetermined distance from the axes of the rollers. As a result, when the rollers turn, the sheets can be fed one by one.

The sheet support tends to curve in such a manner that its right and left ends are lower than its middle.

In general, a sheet support is made of synthetic resin, and includes walls protruding down from its periphery and/or ribs extending longitudinally and laterally on its back in order to improve its rigidity. It is not avoidable for the support to curve in such a manner that the support is convex upward due to the distortion or deformation of the support, which may be caused by the contraction of the peripheral walls after the support is molded.

As stated above, some sheet feeders each include a sheet cassette fitted with a cover and a sheet support which interlock with each other. When the cover opens and closes, the support moves. When the cassette is removed from the feed rollers, and packed and/or kept, the cover keeps pressing the right and left ends of the support urged in the opposite direction at a position or positions inward from these ends. The urging force curves the support in such a manner that the support is convex upward. If the support keeps curved for a long time while it is packed, it may be permanently curved.

When the cover is closed and the cylindrical surfaces of the feed rollers are away from the sheet support, with the support curved in such a manner that its right and left ends are lower than its middle, the only collars positioned near the middle are in contact with the top one of the sheets stacked on the support. As a result, the top sheet is spaced farther than the predetermined distance from the axes of the rollers. Therefore, the rollers may not be able to feed the sheets securely.

SUMMARY OF THE INVENTION

In view of the foregoing problem, a primary object of the present invention is to provide a sheet feeder which can securely feed a sheet of paper with its feed roller by keeping the sheet and the roller spaced at a predetermined distance from each other even if its sheet support is curved. Another object of the invention is to provide a recorder including such a feeder.

A sheet feeder according to a first aspect of the invention includes a sheet support, on which sheets of paper can be stacked. A shaft extends over the support. A feed roller is mounted on the shaft, and can rotate to feed the sheets of paper stacked on the support. An urging member urges at least one of the support and the roller toward the other. Collars are mounted rotatably around the shaft. Each of the collars is in contact at a point or a line with the top one of the sheets placed between the support and the roller and pressed by the collars. The distance between the axis of the shaft and the point or line of contact on at least one of the collars differs from the distances between the shaft axis and the points or lines on the other collars.

When the sheet feeder is ready to feed sheets of paper, that is to say, when sheets are put between the sheet support and the feed roller and pressed by the collars, the distance between the axis of the shaft and the point or line where at least one of the collars is in contact with the top sheet differs from the distances between the shaft axis and the points or lines where the other collars are in contact with this sheet.

If the sheet support is curved widthwise, it is possible to keep the top sheet and the feed roller spaced at a predetermined distance from each other by varying, in accordance with the curvature, the distance between the shaft axis and the point or line of contact on at least one of the collars. As a result, the roller can securely feed the sheets.

The collars function to keep the top sheet and the feed roller spaced at a predetermined distance. The roller is formed as semi-cylindrical, which has a cylindrical surface in a part. When the cylindrical surface of the roller is away from the sheets, the collars also function to keep the sheets from swelling or rising from the sheet support.

Because the sheet support is urged toward the feed roller by the urging means, which may be a coil spring, the support tends to curve or warp in such a manner that its widthwise middle area approaches the roller. Therefore, the distance between the shaft axis and the point or line where at least one of the collars positioned in the widthwise middle area of the support is in contact with the top sheet can be smaller than the distances between the shaft axis and the points or lines where the collars positioned near the lateral ends of the support are in contact with the sheet.

In accordance with a form for embodying the relationship of distance between the shaft axis and the point or line of contact on each collar, at least one of the collars positioned in the widthwise middle area of the sheet support may be smaller in outer diameter than the collars positioned near the lateral ends of the support. In this case, the collars are easy to make.

In accordance with another form, the sheet feeder may further include disks on the shaft. Each of the collars is supported rotatably around each of the disks. The inner periphery of the at least one of the collars is spaced from the periphery of the associated disk. In this case, it is easy to adjust the distances between the shaft axis and the points or lines of contact on the collars.

The disks may have the same diameter. The at least one of the collars may be larger in inner diameter than the collars adjacent to the lateral ends of the sheet support. Otherwise, the disk for the at least one of the collars may be smaller in diameter than the disks for the collars adjacent to the lateral ends of the sheet support. It is easy to vary the inner diameters of the collars and the diameters of the disks when these parts are made. The variations in diameter need only slight changes in design of existing products. It is therefore possible to accommodate or adapt the parts to the curvature of the support at low costs.

A sheet feeder according to a second aspect of the invention includes a sheet support, on which sheets of paper can be stacked. A shaft extends over the support. A feed roller is mounted on the shaft, and can rotate to feed the sheets of paper stacked on the support. An urging member urges at least one of the support and the roller toward the other. Collars are mounted at predetermined intervals around the shaft. At least one of the collars positioned in the widthwise middle area of the support is smaller in outer diameter than the collars positioned near the lateral ends of the support.

A sheet feeder according to a third aspect of the invention includes a sheet support, on which sheets of paper can be stacked. A shaft extends over the support. A feed roller is mounted on the shaft, and can rotate to feed the sheets of paper stacked on the support. An urging member urges at least one of the support and the roller toward the other. Disks are provided at predetermined intervals on the shaft. A collar is supported rotatably around each of the disks. The difference between the inner diameter of at least one of the collars positioned in the widthwise middle area of the support and the diameter of the associated disk is larger than the difference between the inner diameter of each of the collars positioned near the lateral ends of the support and the diameter of the associated disk.

A recorder according to the invention comprises a sheet feeder and a print head for printing information on a sheet of paper. The feeder includes a sheet support, on which sheets of paper can be stacked. A shaft extends over the support. A feed roller is mounted on the shaft, and can rotate to feed the sheets of paper stacked on the support. An urging member urges at least one of the support and the roller toward the other. Collars are mounted rotatably around the shaft. Each of the collars is in contact at a point or a line with the top one of the sheets put between the support and the roller and pressed by the collars. The distance between the axis of the shaft and the point or line of contact on at least one of the collars differs from the distances between the shaft axis and the points or lines on the other collars.

The print head is positioned downstream from the sheet feeder. When the feeder is ready to feed toward the head the sheets of paper stacked on the sheet support, the distance between the axis of the shaft and the point or line where at least one of the collars is in contact with the top sheet differs from the distances between the shaft axis and the points or lines where the other collars are in contact with this sheet.

If the sheet support is curved widthwise, it is possible to keep the top sheet and the feed roller spaced at a predetermined distance from each other by varying, in accordance with the curvature, the distance between the shaft axis and the point or line of contact on at least one of the collars. As a result, the roller can securely feed the sheets downstream toward the print head.

The recorder may further include a cover for covering a rear portion of the sheet support in such a manner that the cover can open and close. When the cover opens, it presses the lateral ends of the support, moving the support against the urging force of the urging member away from the feed roller. By providing such a cover, it is possible to space the support from the roller and the collars so as to set sheets easily on the support when the cover is opened. The support and the cover may function as a sheet cassette.

In each of the sheet feeders and the recorder, the urging member such as a spring may be fitted on the back of the sheet support opposite the feed roller. By fitting the urging member at this position, it is possible for the roller to convey sheets more securely.

BRIEF DESCRIPTION OF THE DRAWINGS

A preferred embodiment of the present invention is shown in the accompanying drawings, in which.

DETAILED DESCRIPTION OF THE EMBODIMENT

Figure 1:
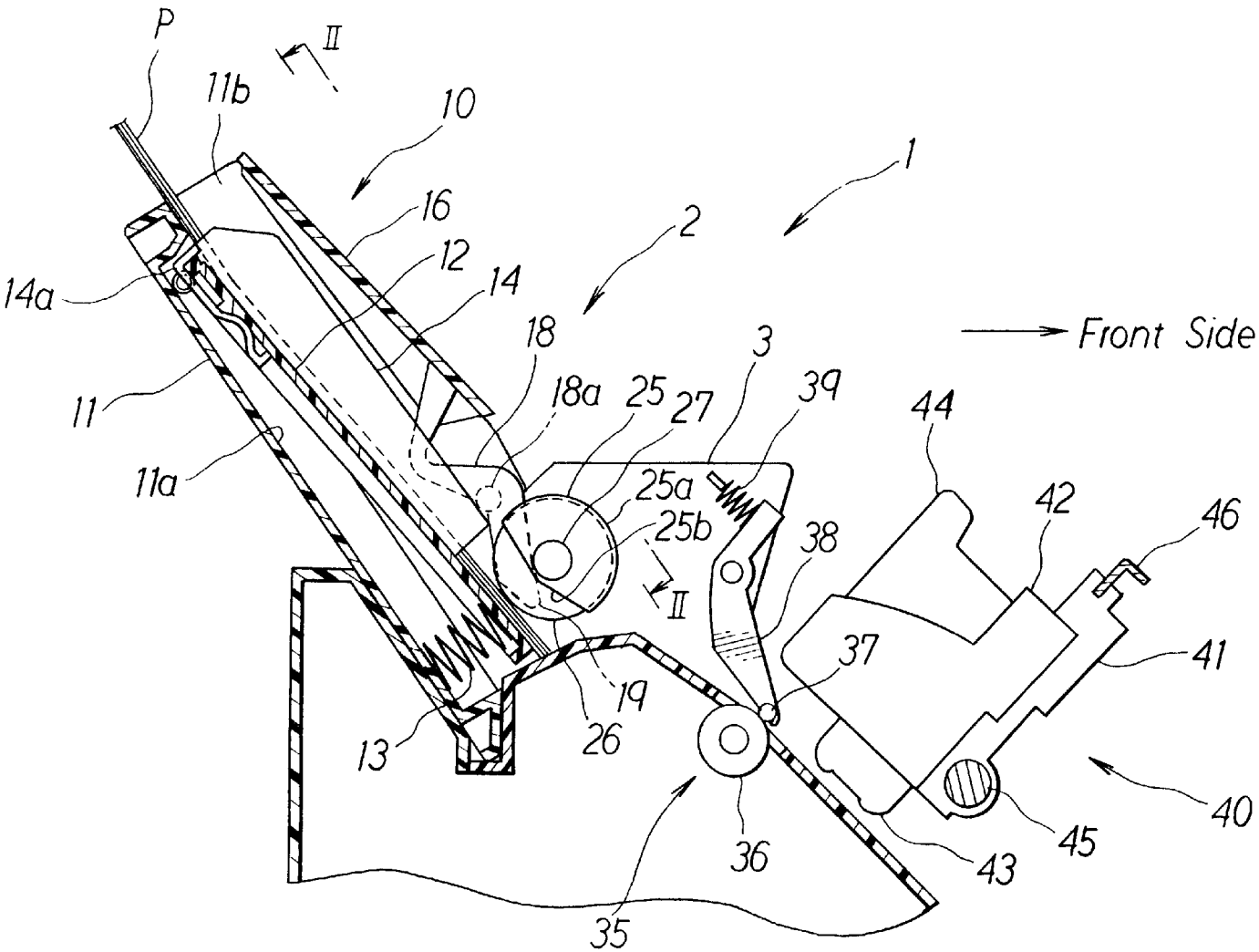
FIG. 1 is a partial cross section of an ink jet printer according to the embodiment.
Figure 2:
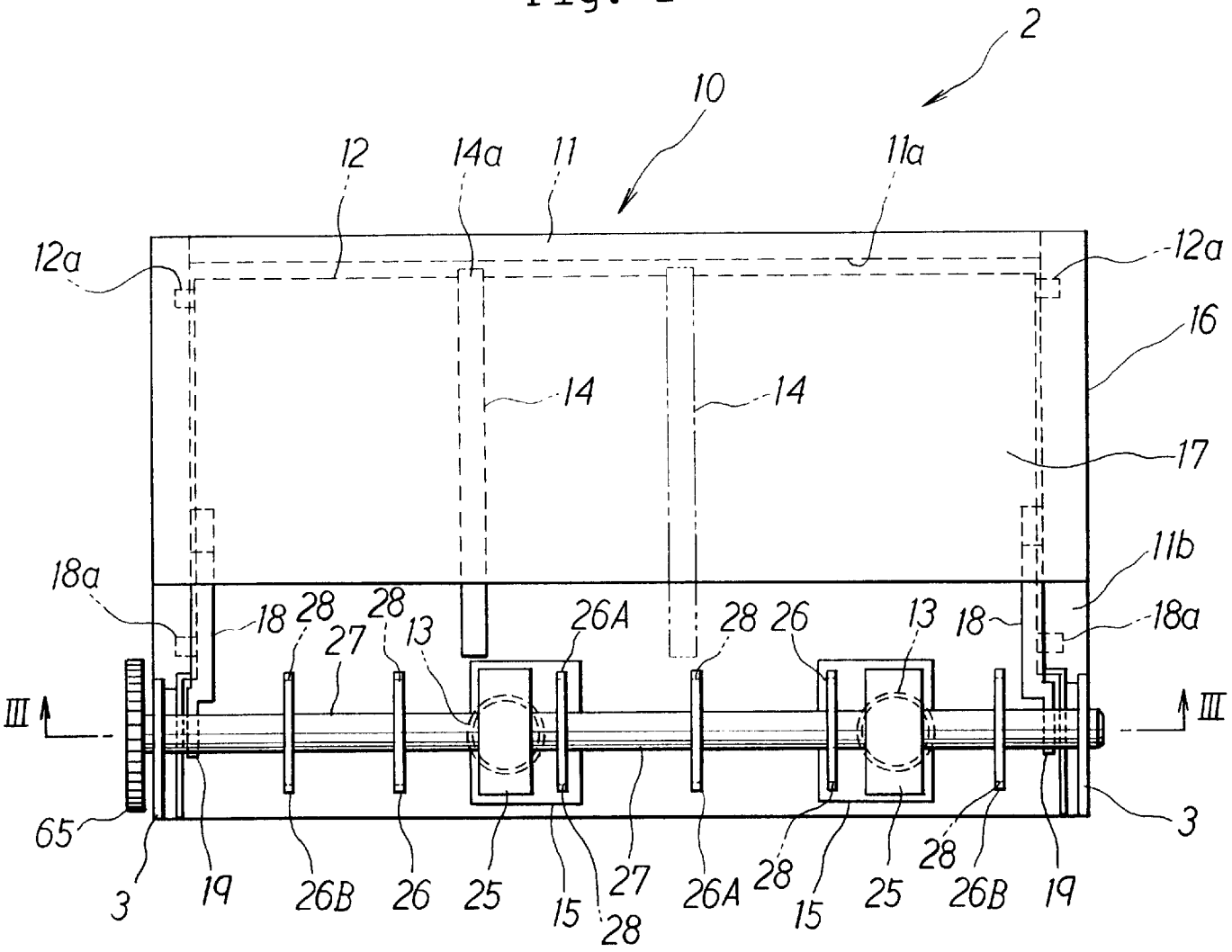
FIG. 2 is a view taken along line II—II of FIG. 1.
Figure 3:
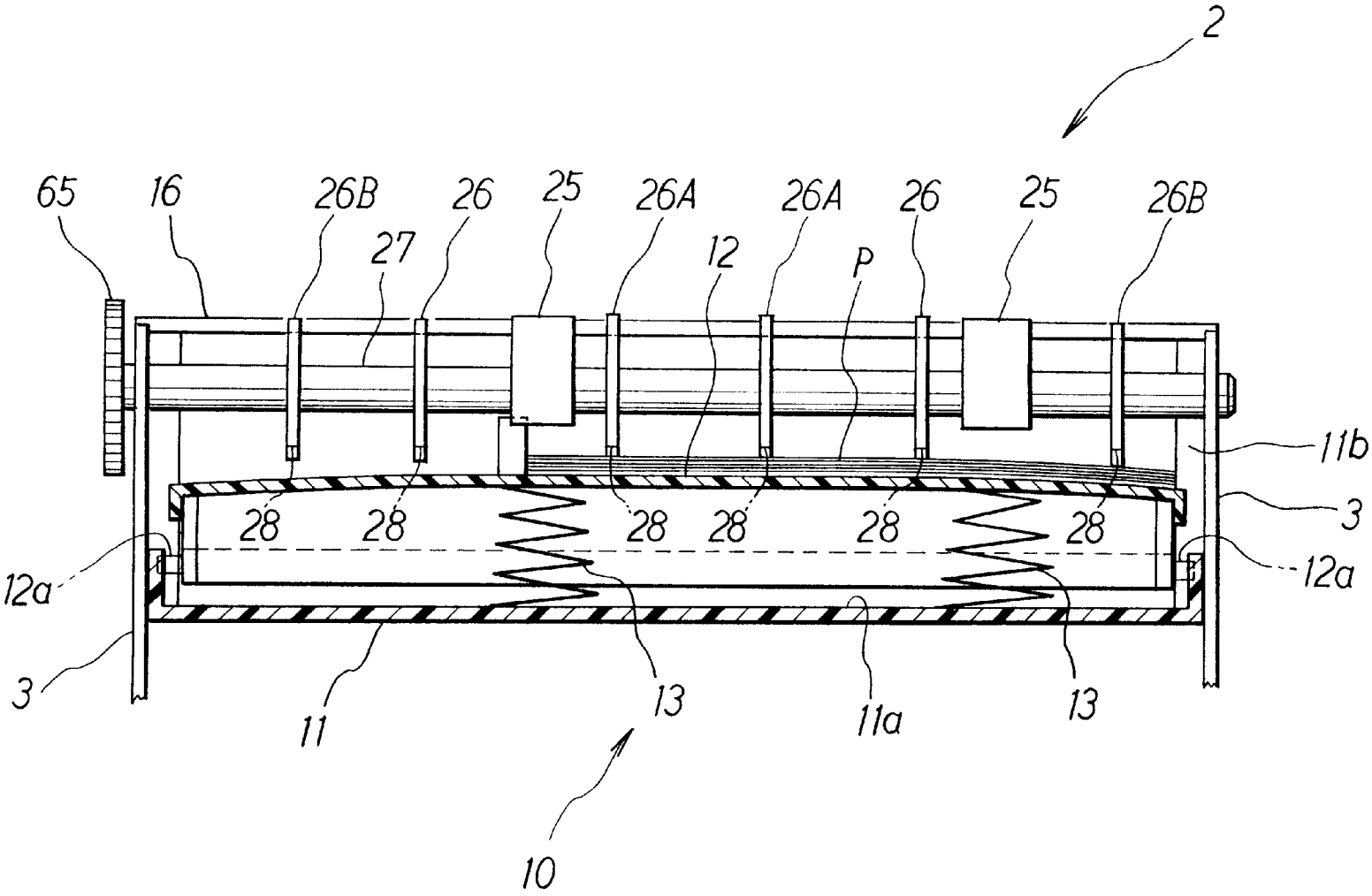
FIG. 3 is a cross section taken along line III—III of FIG. 2.

An embodiment of an ink jet printer according to the invention will be described by using FIG. 1. As shown in FIG. 1, an ink jet printer 1 includes a print unit 40, which includes a print head 43. As shown in FIGS. 1 through 3, a sheet feeder 2 includes a sheet support 12 and semi-cylindrical feed rollers 25, which may be two in number. The feeder 2 can feed one after one the sheets of paper P stacked on the support 12. A sheet conveyer 35 includes a feed roller 36, and conveys toward the head 43 the sheet fed by the feeder 2. The head 43 ejects ink onto the conveyed sheet. A sheet discharger (not shown) includes discharge rollers, and discharges the printed sheet out of the printer 1. A drive 50 (FIG. 7) can rotate the feed rollers 25 and 36 and the discharge rollers.

Structure and components of the sheet feeder 2 will be described below. As shown in FIGS. 1 through 3, the sheet feeder 2 also includes a sheet cassette 10, in which sheets of paper P can be stacked on the sheet support 12. The cassette 10 is fitted removably between both side plates 3 of the printer 1. In order to feed one after one the sheets of paper P stacked on the support 12, the feed rollers 25 can rotate in frictional contact with the top sheet. These rollers 25 are coaxial with collars 26, which may be six in number, for keeping the top sheet P spaced at a predetermined distance from the axes of the rollers 25 when the cylindrical surfaces of the rollers 25 are away from the support 12.

The sheet cassette 10 includes a body 11 having a pair of side plates 11*b*. Defined between the plates 11*b* is a housing space 11*a*, which houses the sheet support 12. The support 12 is connected at its rear end to the cassette body 11 pivotably through horizontal pins 12*a*.

The sheet cassette 10 also includes an edge guide 14 supported horizontally movably on the sheet support 12 so as to guide one edge of each of the sheets P stacked on the support 12. The guide 14 includes a clip 14*a* slidably clipping a rear portion of the support 12.

The sheet cassette 10 is fitted with a pair of right and left compression springs 13 in the housing space 11*a* so as to urge the front end of the sheet support 12 toward the feed rollers 25. The springs 13 are positioned under these rollers 25.

A rear portion of the sheet support 12 is covered with a cover 16, which includes a body 17. A pair of right and left arms 18 are fixed at one end of each arm to the cover body 17. Each arm 18 is supported rotatably at its middle through a horizontal pin 18*a* on the adjacent side plate 11*b* of the cassette body 11. Each arm 18 includes a pusher 19 formed at its other end for pushing the sheet support 12. When the cover 16 opens, the pushers 19 push the right and left ends of a front end portion of the support 12 against the force of the springs 13. This makes the support 12 pivot away from the feed rollers 25.

As shown in FIG. 2, the sheet support 12 includes friction areas 15 protruding slightly from its front end portion. Each area 15 faces one of the feed rollers 25. The areas 15 are higher in friction than the other area.

As shown in FIGS. 2 and 3, a shaft 27 extends horizontally over the sheet support 12, and is supported rotatably at its both ends by the side plates 3 of the printer 1. The feed rollers 25 are fixed to the shaft 27 coaxially with it.

Figure 4:
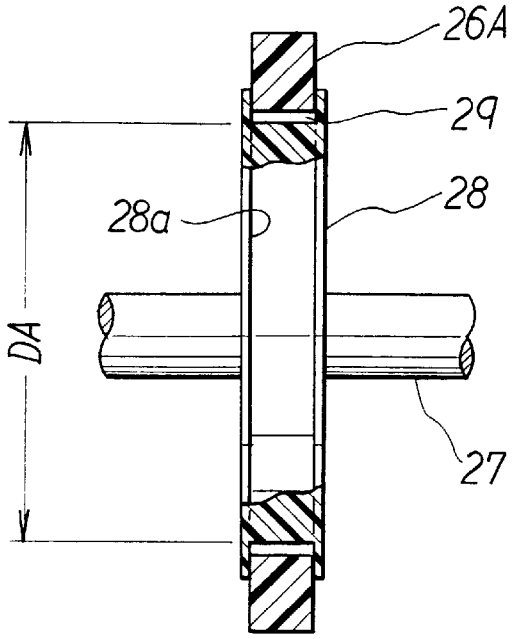
FIGS. 4 and 5 are partial cross sections of the printer, showing a horizontal shaft, disks and collars.
Figure 5:
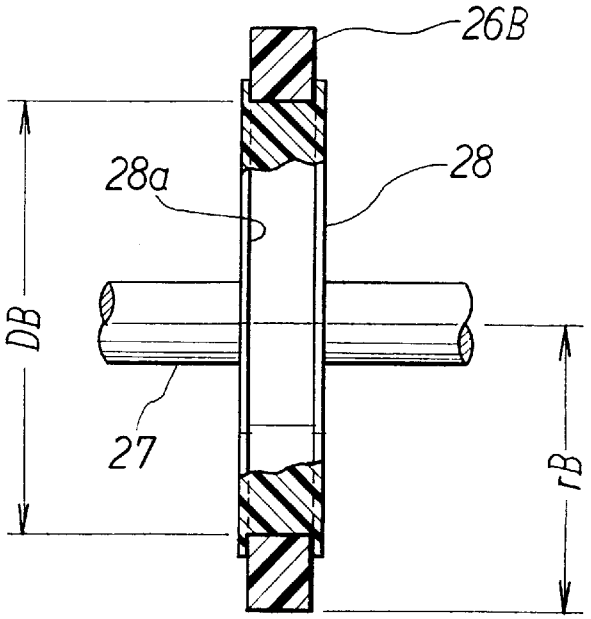

The shaft 27 includes disks 28 formed coaxially with it at nearly regular intervals. The shaft 27 and disks 28 are molded integrally out of synthetic resin. Each disk 28 has a shape like a bobbin. As shown in FIGS. 4 and 5, each disk 28 has a circular or annular recess 28*a* formed in its periphery. Each collar 26 is supported rotatably by one of the grooves 28*a*. Each collar 26 consists of a pair of ring or cylinder halves, which are connected together and assembled in the annular recess 28*a* so as to form an annulus. The collars 26 include middle collars 26A near the middle of the shaft 27 and outer collars 26B near both ends of the shaft 27.

The bottoms of the annular recess 28*a* of the disks 28 in the middle of the shaft 27 have a diameter DA (FIG. 4). The bottoms of the grooves 28*a* of the disks 28 near both ends of the shafts 27 have a diameter DB (FIG. 5), which is larger than the diameter DA. The bottom diameters of the grooves 28*a* decrease toward the middle of the shaft 27. The diameter change is set along the curve of the sheet support 12, which will be explained later.

Figure 6:
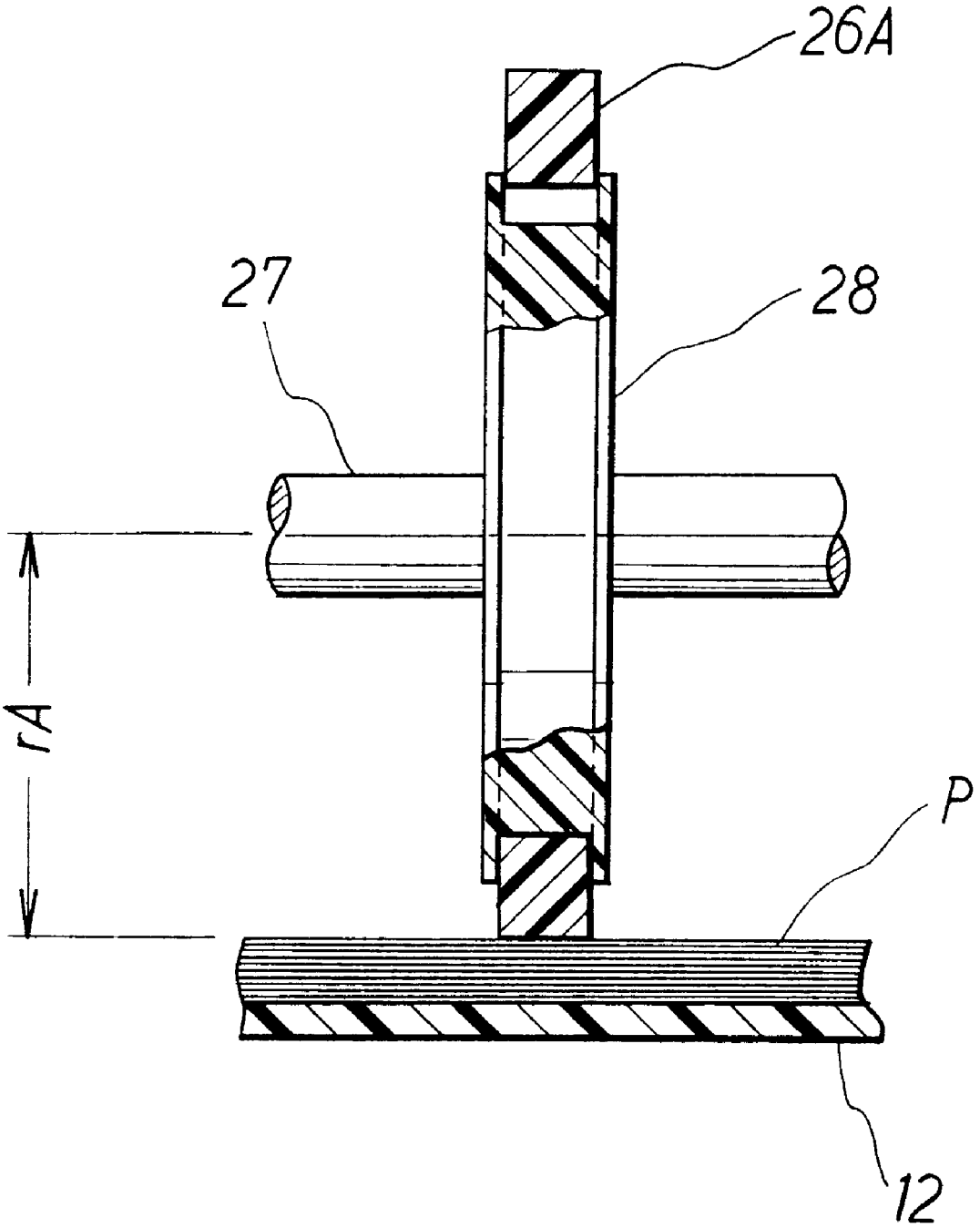
FIG. 6 is a cross section similar to FIG. 4, but showing the collar in a different position.

The collars 26 are identical in width, outer diameter and inner diameter. The outer diameter of the collars 26 is slightly smaller than the diameter of the feed rollers 25. As shown in FIG. 5, each outer collar 26B is fitted closely in the associated disk annular recess 28*a* forming a small gap ($\Delta d2$) between the outer collar 26B and the annular recess 28*a*. As shown in FIG. 4, a circular or annular gap 29 (or $\Delta d1$) is defined between each middle collar 26A and the bottom of the associated annular recess 28*a*. The gaps 29 increase toward the middle of the shaft 27. Accordingly when, as shown in FIG. 6, the collars 26 are in compressive contact with the top one of the sheets P stacked on the sheet support 12, the distance rA between the axis of the shaft 27 and the line of contact between each middle collar 26A and the top sheet P is smaller than the distance rB between this axis and the line of contact between each outer collar 26B and this sheet.

Structure and components of the sheet conveyer 35 will be described below. As shown in FIG. 1, the sheet conveyer 35 includes a feed roller 36, which can be rotated by the drive 50. This roller 36 is fixed to a horizontal shaft, which is supported rotatably by the side plates 3. Arms 38 are supported above the path of conveyance swingably through a horizontal shaft by the side plates 3. Pressure rollers 37 are supported rotatably on one end of each arm 38. The other end of each arm 38 is urged by a compression spring 39 so that the pressure rollers 37 contact compressively with the feed roller 36. When the feed roller 36 is rotated normally (clockwise in FIG. 1), it cooperates with the pressure rollers 37 to convey toward the print head 43 the sheet fed by the semi-cylindrical feed rollers 25.

Structure and component of Print Unit 40 will be described using FIG. 1. As shown in FIG. 1, the print unit 40 includes a carriage 41 supported slidably on and along a horizontal guide rod 45 and a horizontal guide rail 46, which are fixed to the side plates 3 of the printer 1. The carriage 41 can be moved horizontally by a carriage drive (not shown). The carriage 41 supports a holder 42 fixed to it. The holder 42 holds the print head 43 on its rear end. The head 43 is supplied with ink from an ink cartridge 44, which is mounted removably on the holder 42. The head 43 is of the ink jet type for ejecting ink onto a sheet of paper.

Figure 7:
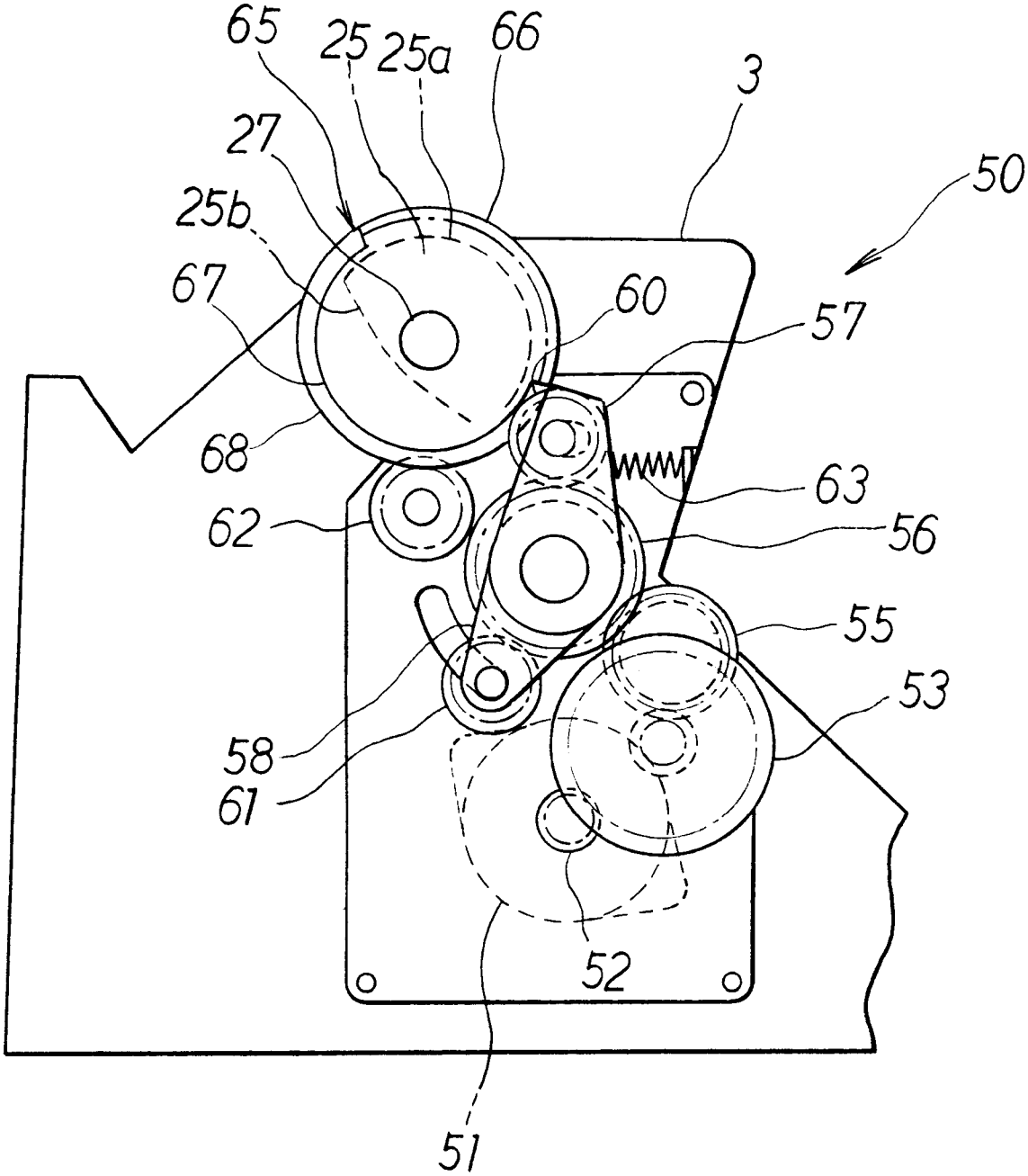
FIG. 7 is a side view of a drive of the printer.
Figure 8:
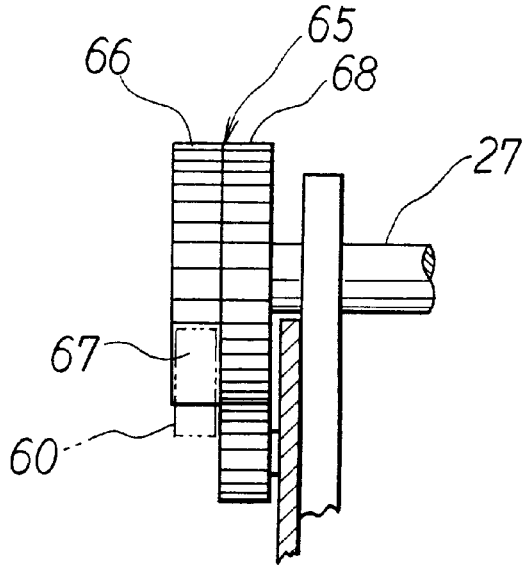
FIGS. 8 and 9 are partial front views of the drive.
Figure 9:
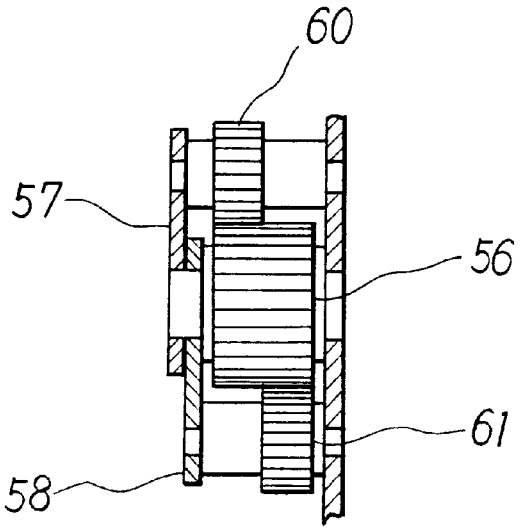

Structure and component of drive 50 will be described. As shown in FIGS. 7 through 9, the drive 50 includes a stepping motor 51, which is controlled for rotation in both directions. A motor gear 52 is fixed to the drive shaft of the motor 51. A reduction gear 53 includes a large-diameter part meshing with the motor gear 52 and a small-diameter part meshing with a feed gear 55, which is fixed to one end of the conveyer feed roller 36.

A sun gear 56 is in mesh with the feed gear 55. A first arm 57 and a second arm 58 are supported pivotably on the axis of the sun gear 56.

A first planet gear 60 and a second planet gear 61 are supported rotatably on the free ends of the arms 57 and 58, respectively. The planet gears 60 and 61 are in mesh with the sun gear 56, and can be revolved by it through friction transmission. Another feed gear 65 is fixed to one end of the shaft 27, and is in mesh with a reversing gear 62. The first planet gear 60 is urged toward the feed gear 65 by a compression spring 63, one end of which is fixed to the first arm 57.

The shaft of the second planet gear 61 is in slidable engagement with an arcuate slot formed through a vertical board, which is fixed to the printer body. When the sun gear 56 turns reversely (clockwise in FIG. 7), the second planet gear 61 moves around it toward the reversing gear 62. When the second planet gear 61 is in mesh with the reversing gear 62, the semi-cylindrical feed rollers 25 turn normally (counter-clockwise in FIG. 7) together with the feed gear 65. Contrariwise, when the sun gear 56 turns normally (counter-clockwise in FIG. 7), the second planet gear 61 moves away from the reversing gear 62.

The feed gear 65 consists of a first part 66 for meshing with the first planet gear 60 and a second part 68 meshing with the reversing gear 62. The first gear part 66 has a peripheral surface 67 without teeth. While this surface 67 is facing the first planet gear 60, this gear 60 and the first gear part 66 are out of mesh with each other.

Feeding operation of sheet feeder 2 will be described. When the previous feeding operation has ended and the next feeding operation has not started, the semi-cylindrical feed rollers 25 are at their initial position shown in FIG. 10, where their cylindrical surfaces 25*a* are away from the sheets of paper P stacked on the sheet support 12. At this stage, the drive 50 is in its initial condition also shown in FIG. 10.

Figure 10:
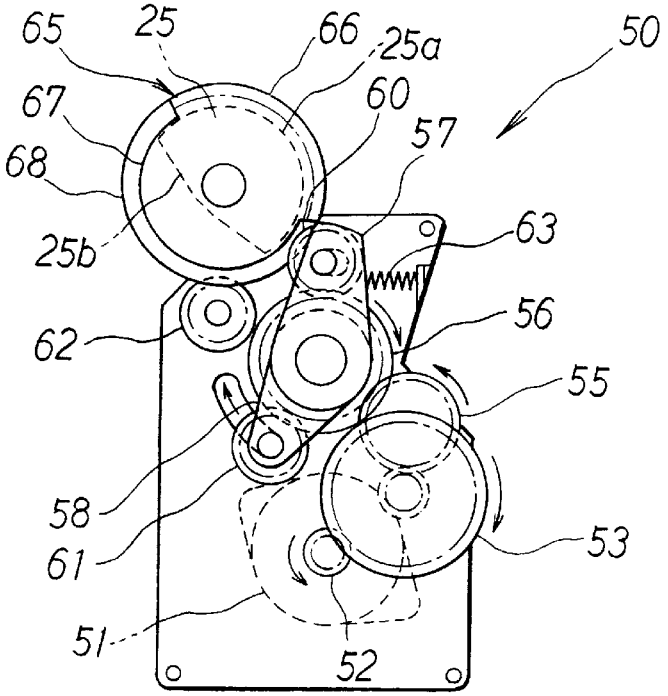
FIGS. 10 through 13 are side views of the drive, showing parts in different positions.
Figure 11:
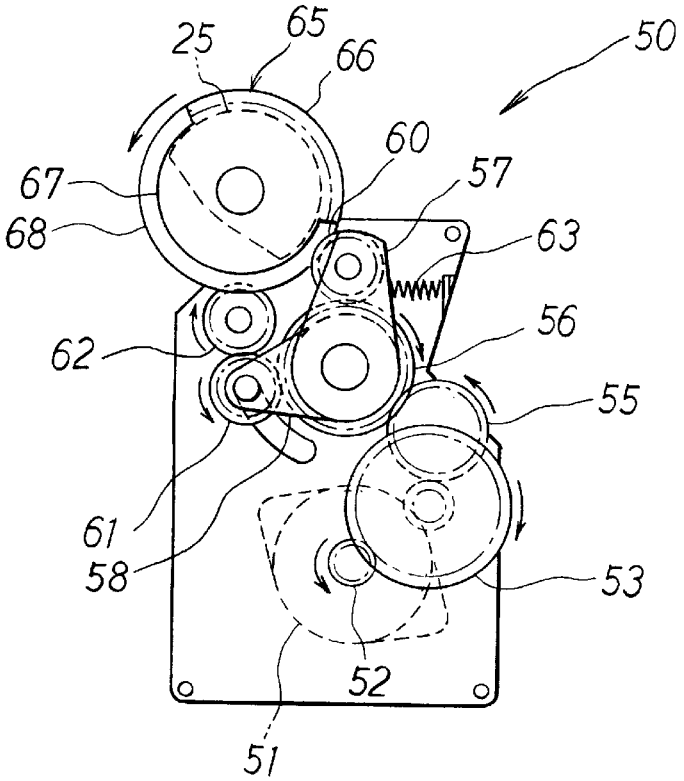

When, at this stage, the stepping motor 51 rotates reversely (counter-clockwise in FIG. 10), the feed gear 55 and conveyer feed roller 36 turn reversely (counter-clockwise in FIG. 10). This prevents a sheet of paper from being conveyed downstream from the feed roller 36. At the same time, the second arm 58 pivots clockwise in FIG. 10. When, as shown in FIG. 11, the second planet gear 61 meshes with the reversing gear 62, the feed gear 65 and semi-cylindrical feed rollers 25 start to turn normally (counter-clockwise in FIG. 11). At this stage, the peripheral surface 67 of the feed gear 65 faces the first planet gear 60.

After the cylindrical surfaces 25*a* of the feed rollers 25 come into contact with the top sheet P, these rollers 25 feed the top sheet by a predetermined amount toward the sheet conveyer 35. The front end of the sheet then comes into contact with the contact line between the conveyer feed roller 36 and pressure rollers 37. At the contact line, the position and direction of the front end of the sheet is adjusted accurately with respect to the conveyer 35.

Figure 12:
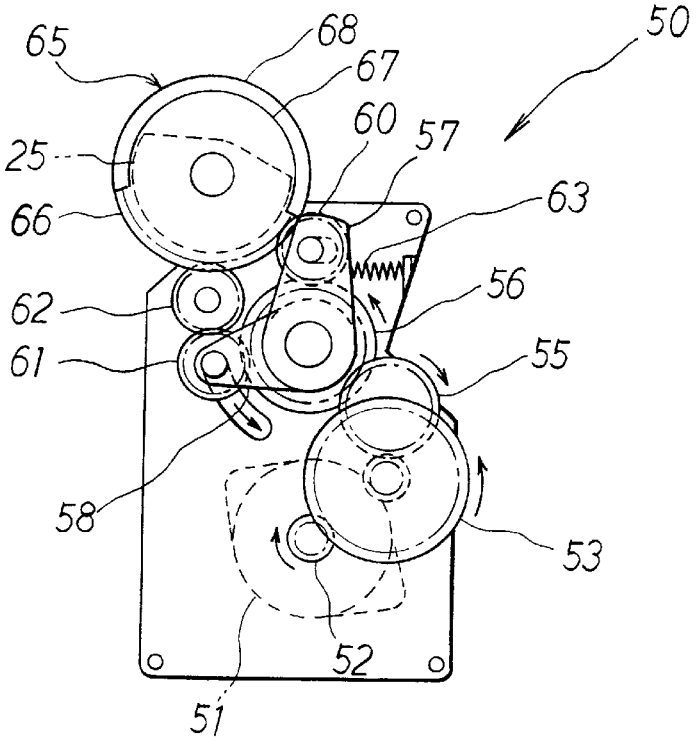

When the stepping motor 51 has rotated reversely by a predetermined amount, the leading end of the first gear part 66 faces the first planet gear 60, as shown in FIG. 12, but they do not mesh with each other because this gear part 66 and this planet gear 60 are turning in the same direction.

Figure 13:
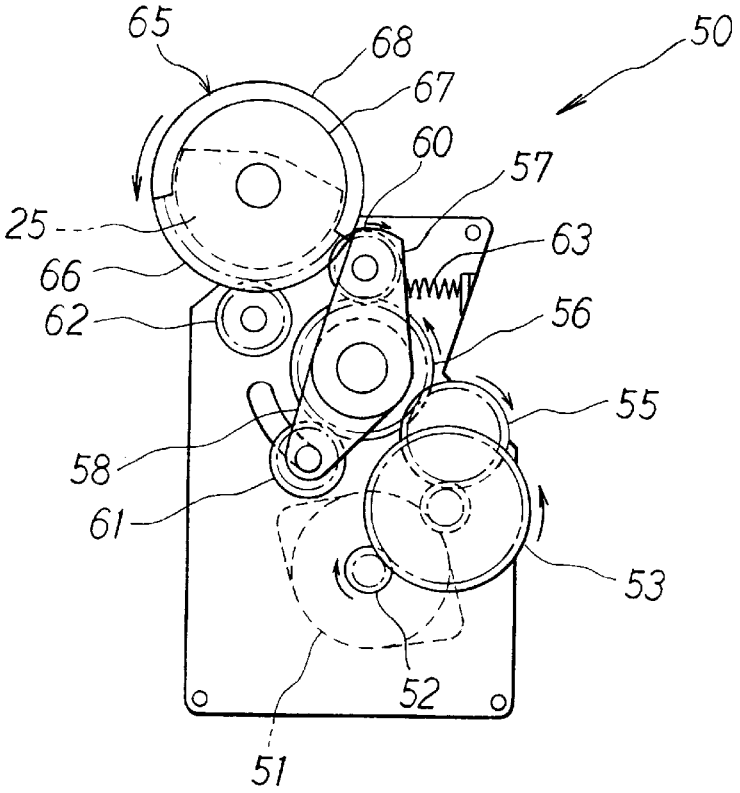

Thereafter, when the stepping motor 51 changes its direction of rotation to normal rotation, as shown in FIG. 12, the feed gear 55 and conveyer feed roller 36 turn normally. At the same time, the second planet gear 61 moves away from the reversing gear 62, as shown in FIG. 13, with the second arm 58 pivoting counter-clockwise. The first planet gear 60 then meshes with the first gear part 66 so as to turn the feed gear 65 and semi-cylindrical feed rollers 25 normally. As a result, the sheet is conveyed toward the print head 43.

Operation of Sheet Feeder 2 will be described below. When the cassette cover 16 opens, the pushers 19 of the arms 18 push the right and left ends of the sheet support 12. Consequently, the front end of the support 12 pivots against the urging force of the springs 13 away from the shaft 27. This spaces the support 12 from the collars 26 with the semi-cylindrical feed rollers 25 at their initial position, where the cylindrical surfaces 25*a* are away from the support 12. As a result, sheets of paper P can be stacked on the support 12.

When the cover 16 closes, as shown in FIG. 1, the springs 13 return the front end of the support 12 toward the feed rollers 25 so as to bring the top sheet into contact with the collars 26. On the other hand, the pushers 19 are spaced from the top sheet. When these rollers 25 rotate under this condition, the sheets P are fed one after one.

The sheet support 12 is made of synthetic resin and, as shown in FIGS. 1 and 3, includes a main plate and peripheral ribs for improving its rigidity. The ribs protrude down from the periphery of the plate. After molded, such a sheet support may be distorted or deformed, and therefore tends to curve in such a manner that its right and left ends are lower than its middle. Besides, when the sheet cassette 10 is removed from the printer 1, and packed and/or kept, the arms 18 of the cover 16 keep pressing the right and left ends of the support 12, which is urged in the opposite direction by the springs 13 positioned inward from the pushers 19. As a result, the support 12 curves in such a manner that its right and left ends are lower than the middle. If packing or the like keeps the support 12 curved for a long time, the support may be permanently curved.

When the collars 26 are in compressive contact with the top one of the sheets P stacked on the sheet support 12, as stated already, the distance rA between the axis of the shaft 27 and the line of contact between each middle collar 26A and the top sheet is smaller than the distance rB between this axis and the line of contact between each outer collar 26B and this sheet (see FIGS. 4 and 5). Accordingly, even if the sheet support 12 is curved as shown in FIG. 3, the sheet P can be spaced at the predetermined distance from the feed rollers 25. As a result, the rollers 25 can securely feed the sheets P.

A gap 29 is formed between each middle collar 26A and the associated disk 28. This simple structure makes it possible to reduce the distance between the axis of the shaft 27 and the line where the collar 26A is in compressive contact with the top sheet P. Besides, the collars 26 are identical in shape, while the disks 28 are different in diameter and formed integrally with the shaft 17. This makes it unnecessary to provide a number of collars of different sizes, thereby reducing the production costs.

Instead of forming the gap 29 between each middle collar 26A and the associated disk 28, the middle collars 26A might be smaller in outer diameter than the outer collars 26B so that the distance between the axis of the shaft 27 and the line where each middle collar 26A is in compressive contact with the top sheet P is smaller than the distance between the shaft axis and the line where each outer collar 26B is in compressive contact with this sheet.

Otherwise, the disks 28 might be identical in shape, and the inner diameters of the middle collars 26A might be enlarged to form the gaps 29.

The sheet support 12 has been described as curved in such a manner that its widthwise middle area approaches the feed rollers 25. Something might, however, curve the support 12 in the opposite direction, or make it irregular otherwise. It is possible to adapt the invention to such irregularities by properly adjusting the distances between the axis of the shaft 27 and the points or lines on collars 26 in contact with the top sheet P at the irregularities of the support 12.

The recorder of the invention has been described as an ink jet printer. Within its scope, however, the invention can be applied to not only ink jet printers, but also other printers such as laser printers and dot printers, copying machines, facsimile machines, and other recorders. In particular, the invention is effective for a sheet support larger in width than in length.

What is claimed is:

1. A sheet feeder comprising:

a sheet support on which sheets of paper are stacked;

a shaft extending over the sheet support;

a feed roller mounted on the shaft, the feed roller being rotatable to feed the sheets of paper stacked on the support;

an urging member urging at least one of the support and the feed roller toward the other;

a first disk coaxially provided on the shaft in a widthwise middle area of the sheet support, the first disk having an annular recess formed around a periphery of the first disk;

a second disk coaxially provided on the shaft in a side area of the sheet support, the second disk having an annular recess formed around a periphery of the second disk;

a first collar rotatable supported in the annular recess of the first disk;

a second collar rotatably supported in the annular recess of the second disk; and a difference Δd1 between the inner diameter of the first collar and an outer diameter of the annular recess of the first disk is larger than a difference Δd2 between an inner diameter of the second collar and an outer diameter of the deepest surface portion of the annular recess of the second disk.

2. The sheet feeder of claim 1, wherein the Δd1 and Δd2 are determined in accordance with an estimated curvature of the sheet support.

3. The sheet feeder of claim 1, wherein the annular recess of the first and second disks have the same outer diameter, and the inner diameter of the first collar is larger than the inner diameter of the second collar.

4. The sheet feeder of claim 1, wherein the annular recess of the first disk is smaller in outer diameter than the annular recess of the second disk.

5. The sheet feeder of claim 1, wherein the sheet support is curved in such a manner that the widthwise middle area of the support approaches the feed roller, and the Δd1 and Δd2 is determined in accordance with the curvature of the support.

6. The sheet feeder of claim 1, further comprising a cover for covering a rear portion of the sheet support in such a manner than the cover can open and close, the cover pressing lateral ends of the support, when opening, to move the support against the urging force of the urging member away from the feed roller.

7. The sheet feeder of claim 6, wherein the sheet support and the cover function as a sheet cassette, which can be fitted and removed with respect to the feed roller.

8. The sheet feeder of claim 1, wherein the urging member is a spring fitted on the back side of the sheet support.

9. The sheet feeder of claim 8, wherein the spring is fitted on the back of the sheet support opposite the feed roller.

10. The sheet feeder of claim 1, wherein the first and second collars can be eccentric to the shaft while being rotatably supported in the annular recess.

11. The sheet feeder of claim 1, wherein the first and second disk each have a pair of flange portions provided on both sides of the disk, and the annular recess is defined between the flange portions.

12. A recorder comprising a sheet feeder and a print head for printing information on a sheet of paper, the feeder including:

a sheet support on which sheets of paper are stacked;

a shaft extending over the sheet support;

a feed roller mounted on the shaft, the feed roller being rotatable to feed the sheets of paper stacked on the support;

an urging member urging at least one of the support and the roller toward the other;

a first disk coaxially provided on the shaft in a widthwise middle area of the sheet support, the first disk having an annular recess formed around a periphery of the disk;

a second disk coaxially provided on the shaft in a side area of the sheet support, the second disk having an annular recess formed around a periphery of the disk;

a first collar rotatably supported in the annular recess of the first disk;

a second collar rotatable supported in the annular recess of the second disk; and a difference Δd1 between an inner diameter of the first collar and an outer diameter of the deepest surface portion of the annular recess of the first disk being larger than a difference Δd2 between an inner diameter of the second collar and an outer diameter of the annular recess of the second disk.

13. The recorder of claim 12, wherein the Δd1 and Δd2 are determined in accordance with an estimated curvature of the sheet support.

14. The recorder of claim 12, wherein the annular recesses of the first and second disks have the same outer diameter and the inner diameter of the first collar is larger than the inner diameter of the second collar.

15. The recorder of claim 12, wherein the annular recess of the first disk has a smaller outer diameter than the outer diameter of the annular recess of the second disk.

16. The recorder of claim 12, wherein the sheet support is warped in such a manner that the widthwise middle area of the support approaches the feed roller, the Δd1 and Δd2 being determined in accordance with the warp of the support.

17. The recorder of claim 12, wherein the sheet feeder further includes a cover for covering a rear portion of the sheet support in such a manner that the cover can open and close, the cover pressing lateral ends of the support, when opening, to move the support against the urging force of the urging member away from the feed roller.

18. The recorder of claim 17, wherein the sheet support and the cover function as a sheet cassette, which can be fitted and removed with respect to the feed roller.

19. The recorder of claim 12 wherein the feed roller has a shape of semi-cylindrical.

20. The recorder of claim 12, being an ink jet printer.

21. The recorder of claim 12, wherein the first and second collars can be eccentric to the shaft while being rotatably supported in the annular recess.

22. The recorder of claim 12, wherein the first and second disk each have a pair of flange portions provided on both sides of the disk, and the annular recess is defined between the flange portions.

* * * * *